US005462901A

United States Patent [19]

Egami et al.

[11] Patent Number: 5,462,901

[45] Date of Patent: Oct. 31, 1995

[54] CERMET SINTERED BODY

[75] Inventors: Akira Egami; Masaya Ehira, both of Akashi, Japan

[73] Assignee: Kabushiki Kaisha Kobe Seiko Sho, Kobe, Japan

[21] Appl. No.: 246,746

[22] Filed: May 20, 1994

[30] Foreign Application Priority Data

May 21, 1993 [JP] Japan ..... 5-120253

[51] Int. Cl.[6] ..... C04B 35/56

[52] U.S. Cl. ..... 501/87; 501/96; 75/242

[58] Field of Search ..... 501/87, 96; 419/13, 419/14, 15; 75/242, 238, 244

[56] References Cited

U.S. PATENT DOCUMENTS

| | | | |
|---|---|---|---|
| 4,375,517 | 3/1983 | Watanabe et al. | 501/87 |
| 4,451,292 | 5/1984 | Hall et al. | 419/15 X |
| 4,636,252 | 1/1987 | Yoshimura et al. | 75/242 X |
| 4,904,445 | 2/1990 | Iyori et al. | 75/242 X |
| 4,948,425 | 8/1990 | Watanabe et al. | 75/242 X |
| 4,990,410 | 2/1991 | Saitoh et al. | 419/15 X |
| 5,053,074 | 10/1991 | Buljan et al. | 75/242 X |
| 5,145,505 | 9/1992 | Saito et al. | 419/15 X |
| 5,306,326 | 4/1994 | Oskarsson et al. | 75/242 X |
| 5,330,553 | 7/1994 | Weinl et al. | 75/242 X |

*Primary Examiner*—Karl Group

*Attorney, Agent, or Firm*—Oblon, Spivak, McClelland, Maier, & Neustadt

[57] ABSTRACT

A cermet sintered body excellent in wear resistance, oxidation resistance and toughness, which is suitable for cutting tools. The cermet sintered body includes: a hard dispersion phase in an amount of from 70 to 95 wt. %, which contains TiC and/or Ti(C, N) and carbides (excluding TiC) and/or nitrides of one or more kinds selected from a group consisting of elements in IVa, Va, and VIa groups of the periodic system, and a binder phase in an amount of from 5 to 30 wt. %, which contains one kind or two or more kinds of iron family elements. Moreover, the average particle size of a raw powder of TiC and/or Ti(C, N) is in the range of 1.0 μm or less, and TiC and/or Ti(C, N) are directly dissolved in a solid state in the carbides (excluding TiC) and/or nitrides during sintering, to form a hard dispersion phase. The hard dispersion phase thus obtained mainly contains solid-solutions without any structure having a core, and which has a uniform distribution of composition.

11 Claims, No Drawings

CERMET SINTERED BODY

BACKGROUND OF THE INVENTION

1. Field of the Invention

The present invention relates to a cermet sintered body suitable for cutting tools or the like, and particularly to a cermet sintered body which is excellent in wear resistance, oxidation resistance and toughness at high temperatures, and which achieves a high cutting performance even in severe cutting conditions when used for cutting tools.

2. Description of the Related Art

The development of cermet sintered bodies containing ceramics and metals has been started from a TiC-Ni-Mo system containing TiC as a main component of a hard dispersion phase and slight amounts of Ni and Mo.

The cermet of this type has been used for only limited purpose because of the low toughness, and the low stability against wear and oxidation at high temperatures. In recent years, a development has been made to obtain cermet sintered bodies having a high toughness and a high temperature strength by the addition of nitrogen (for example, TiC-TiN-Ni-Mo system). As a result, the applications of the cermet sintered bodies as cutting tools have been significantly expanded. In terms of improvement of characteristics of cermet sintered bodies, an attempt has been made to add carbides (excluding TiC) and nitrides of elements in IVa, Va, and VIa groups of the periodic system. Nitrogen (N) may be added to a cermet sintered body in the form of TaN, other than the above-described form of TiN, and further in the form of Ti(C, N) together with TiC or in place of TiC.

It is well known that a cermet sintered body used for cutting tools contains a lot of structures having relatively large cores (hereinafter, referred to as the core-structure) of TiC or Ti(C, N).

The core-structures include two types: (b) a core-structure having a core in which TiC or Ti(C, N) is dissolved in a solid state in other solid-solution components; and (a) a core-structure having a core of TiC or Ti(C, N).

In addition, the type of (b) is called a white core-structure, and the type of (a) is called a black core-structure by observation electron microscope (SEM)

The grain containing a lot of the above-described core-structures exert adverse effect on the characteristics of the cermet sintered body such as the wear resistance, chipping resistance, and oxidation resistance.

To cope with the problem, techniques of fabricating cermet sintered bodies having no core-structure have been proposed in Examined Japanese Patent Publication No. SHO 63-35704. These techniques are intended to fabricate a cermet sintered body using a complex powder made of solid-solutions of carbides/nitrides of metals. However, these techniques have the following disadvantage. In preparing such a complex powder, the solid-solutions of carbides/nitrides of metals are formed at a high temperature, and thereby grains of a powder of the solid-solutions are greatly grown. The powder having a large particle size must be crushed. The crushing process not only increases a cost, but also causes another problem that the crushed powder is irregular and angular in shape and has a large distribution of particle size, which rather reduces the toughness.

SUMMARY OF THE INVENTION

To solve the above problems, the present invention has been made, and an object of the present invention is to provide a cermet sintered body excellent in wear resistance, oxidation resistance and toughness at high temperatures, which is suitable for cutting tools.

To achieve the above object, according to the present invention, there is provided a cermet sintered body including: a hard dispersion phase in an amount of from 70 to 95 wt. %, which contains TiC and/or Ti(C, N) and carbides (excluding TiC) and/or nitrides of one or more kinds selected from a group consisting of elements in IVa, Va, and VIa groups of the periodic system, and a binder phase in an amount of from 5 to 30 wt. %, which contains one kind or two or more kinds of iron family elements. Moreover, the average particle size of a raw powder of TiC and/or Ti(C, N) is in the range of 1.0 μm or less, and TiC and/or Ti(C, N) are directly dissolved in a solid state in the carbides (excluding TiC) and/or nitrides during sintering, to form a hard dispersion phase. The hard dispersion phase thus obtained mainly contains solid-solutions without any structure having a core, and which has a uniform distribution of composition.

DETAILED DESCRIPTION OF THE PREFERRED EMBODIMENT

Prior to the description of a preferred embodiment of the present invention, the mechanism of a cermet sintered body of the present invention will be described below.

The present inventors have studied to fabricate a cermet excellent in wear resistance, oxidation resistance and toughness at high temperatures, and have found the following knowledge. TiC and/or Ti(C, N) are dissolved in a solid state in carbides (excluding TiC) and/or nitrides of one or more kinds selected from a group consisting of elements in IVa, Va, and VIa groups of the periodic system during sintering, to form a hard dispersion phase. In this case, the particle size of each powder of TiC and/or Ti(C, N) is specified in a range of 1.0 μm or less. The hard dispersion phase thus obtained mainly contains solid-solutions having no core-structure, and has a uniform distribution of composition. The cermet sintered body having the above-described composition and grain is excellent in wear resistance, oxidation resistance and toughness at high temperatures.

The cermet sintered body of the present invention, basically, mainly contains the solid-solutions having no core-structure and has a uniform distribution of composition. However, part of the hard dispersion phase contains either or both of (1) a grain composed of structures having cores of TiC and/or Ti(C, N) dissolved in a solid state in other solid-solution components, and (2) a fine grain, having an average particle size of 1 μm or less, which is composed of structures having cores of TiC and/or Ti(C, N). The mixing of these grain (1) and (2) in slight amounts does not exert adverse effect on the characteristics of the cermet sintered body of the present invention so much.

Moreover, in the above-described cermet sintered body, the average particle size of a raw powder of TiC and/or Ti(C, N) is preferably specified to be in the range of 0.3 μm or less. The hard dispersion phase thus obtained mainly contains solid-solutions without any structure having a core, and which has a uniform distribution of composition, and further does not substantially contain any structure having a core of TiC and/or Ti(C, N).

The cermet sintered body of the present invention contains a hard dispersion phase in an amount of from 70 to 95 wt. %, and a binder phase in an amount of from 5 to 30 wt. % which contains one kind or two or more kinds of iron family elements. The reason why the content of each phase is limited is as follows. When the hard dispersion phase is less than 70 wt. % (the binder phase is more than 30 wt. %), the content of the binder phase is excessively large, so that it is difficult to ensure the wear resistance. When the hard dispersion phase is more than 95 wt. % (the binder phase is less than 5 wt. %), the content of the binder is excessively small, so that it is difficult to ensure the toughness.

In the cermet sintered body of the present invention, the average particle size of the sintered body is preferably in the range of 1 μm or less. Over 1 μm, it is difficult to ensure the basic characteristics such as wear resistance, oxidation resistance and toughness, thus reducing the effect of the present invention. In addition, to specify the average particle size of the sintered body in the range of 1 μm or less, the sintering temperature and sintering assistant may be suitably adjusted, in addition to the control of the average particle sizes of raw materials other than TiC and/or Ti(C, N).

The cermet sintered body of the present invention is fabricated in the following procedure. Raw powders of TiC and/or Ti(C, N) each having an average particle of 1.0 μm or less are wet-mixed with raw powders of carbides and/or nitrides of elements in IVa, Va, and VIa groups of the periodic system. The mixed powder is pelletized, dried, compacted, and sintered.

In the sintering process, the above-described carbides or nitrides are dissolved in a solid state in TiC and/or Ti(C, N) before a liquid phase is generated. After that, along with the generation of the liquid phase, melting and precipitation are started, to form an surrounding structure around TiC and/or Ti(C, N). In the conventional cermet, since the particle sizes of raw powders of carbide and/or nitride are large and the diffusion distances between the particles thereof are long, the carbide and/or nitride are not sufficiently dissolved in a solid state in the particles of TiC and/or Ti(C, N). The present inventors have found the fact that Co and Ni added to form a binder phase act as catalyst for the solid-solution between the carbide and/or nitride and TiC or Ti(C, N). In the cermet sintered body of the present invention, as elements for forming a binder phase, Fe may be added, other than Co and Ni. In the present invention, therefore, the metals for forming a binder phase are specified to be iron family elements.

The addition of raw powders of TiC and/or Ti(C, N) each having an average particle size of 1.0 μm is combined with the catalytic action of Co and Ni to allow the above carbides or nitrides to be dissolved in a solid state in TiC and/or Ti(C, N) near the centers of or over the surfaces of the particles thereof before a liquid phase is generated upon sintering.

The hard dispersion phase of the cermet sintered body thus obtained mainly contains the solid-solutions with no core-structure, and has a uniform distribution of composition. Moreover, using the raw powders of TiC and/or Ti(C, N) each having an average particle size of 0.3 μm or less, the grain does not substantially contain the structures having cores of only TiC and/or Ti(C, N). The above-described cermet sintered body is significantly excellent in the wear resistance, oxidation resistance and toughness at high temperatures.

Although the cermet sintered body of a type in which N is added has been described, the cermet sintered body of the present invention is not limited to the type in which N is added. The core-structure is possibly contained in a cermet sintered body in which N is not added (such as TiC-$Mo_2C$-Ni system). The present invention may be also applied to a cermet sintered body of this type. In some cases, a cutting tool made of a cermet sintered body is coated with a hard film of TiN TiAlN or the like. Such a coating may be applied to the cermet sintered body of the present invention.

The present invention will be more apparent by way of the following example.

EXAMPLE 1

Drills were fabricated using cermet sintered bodies having various compositions shown in Table 1, and they were subjected to a drilling test under the following conditions.

(Cutting Condition)
Drill diameter: 8 mmϕ
Cutting speed: 80 m/min
Feed rate: 0.2 mm/rev
Work material: JIS S50C ($K_B$: 240 to 260)
Cutting length: 16 mm (pass through)
Extension length: 65 mm
Cutting Oil: Cool E (water-soluble type, trade name)

TABLE 1

| | Composition (wt %) | | | | | | | | | | | | | |
|---|---|---|---|---|---|---|---|---|---|---|---|---|---|---|
| No. | TiC | TiN | Ti(C, N) | ZrC | HfC | VC | NbC | TaC | $Cr_3C_2$ | $Mo_2C$ | WC | Co | Ni | Remarks |
| 1 | 32 | 14 | — | — | — | — | — | 9 | — | 9 | 18 | 12 | 6 | Inventive Example |
| 2 | 32 | 14 | — | — | — | — | — | 9 | — | 9 | 18 | 12 | 6 | " |
| 3 | 32 | 14 | — | — | — | — | — | 9 | — | 9 | 18 | 12 | 6 | " |
| 4 | 32 | 14 | — | — | — | — | — | 9 | — | 9 | 18 | 12 | 6 | " |
| 5 | — | — | 46 | — | — | — | — | 9 | — | 9 | 16 | 12 | 6 | " |
| 6 | — | — | 46 | — | — | — | — | 9 | — | 9 | 16 | 9 | 9 | " |
| 7 | 33.3 | 14.7 | — | 3 | — | — | — | 6 | — | 9 | 16 | 9 | 9 | " |
| 8 | 33.3 | 14.7 | — | — | 3 | — | — | 6 | — | 9 | 16 | 9 | 9 | " |
| 9 | 33.3 | 14.7 | — | — | — | 3 | — | 6 | — | 9 | 16 | 9 | 9 | " |
| 10 | 33.3 | 14.7 | — | — | — | — | 3 | 6 | — | 9 | 16 | 9 | 9 | " |
| 11 | 33.3 | 14.7 | — | — | — | — | — | 6 | 3 | 9 | 16 | 9 | 9 | " |
| 12 | 34.6 | 15.4 | — | — | — | — | — | 9 | — | 9 | 18 | 7 | 7 | " |
| 13 | 34.6 | 15.4 | — | — | — | — | — | 9 | — | 9 | 14 | 9 | 9 | " |
| 14 | 34.6 | 15.4 | — | — | — | — | — | 9 | — | 9 | 12 | 10 | 10 | " |
| 15 | 32 | 14 | — | — | — | — | — | 9 | — | 9 | 18 | 12 | 6 | Comparative Example |
| 16 | 32 | 14 | — | — | — | — | — | 9 | — | 9 | 18 | 12 | 6 | " |
| 17 | 33.3 | 14.7 | — | — | — | — | — | 6 | — | 9 | 16 | 9 | 9 | " |
| 18 | 34.6 | 15.4 | — | — | — | — | — | 9 | — | 9 | 16 | 7 | 7 | " |

Table 2 shows the result of the drilling test. As is apparent from Table 2, each of the cermet sintered bodies of the present invention (Sample Nos. 1 to 14) exhibits a high performance, that is, a total cutting length of 40 m or more even under the severe condition of a cutting speed of 80 m/min. On the contrary, each of the conventional cermet sintered bodies (Sample Nos. 15 to 18) generate wear and chipping in the early state resulting in the poor life because the grain of each sintered body is coarse or contains a lot of core-structures having cores of TiC or Ti(C, N).

TABLE 2

| No. | Average Particle of Powders of TiC and/or Ti(C, N) (μm) | (TiAl) Coating Absence | (TiAl) Coating Presence | Total Cutting Length (m) | Remarks |
|---|---|---|---|---|---|
| 1 | 0.3 | ○ | — | 55 | Inventive Example |
| 2 | 0.3 | — | ○ | 75 | " |
| 3 | 0.5 | ○ | — | 50 | " |
| 4 | 0.8 | ○ | — | 45 | " |
| 5 | 0.8 | ○ | — | 50 | " |
| 6 | 0.8 | ○ | — | 52 | " |
| 7 | 0.5 | ○ | — | 43 | " |
| 8 | 0.5 | ○ | — | 45 | " |
| 9 | 0.5 | ○ | — | 43 | " |
| 10 | 0.5 | ○ | — | 45 | " |
| 11 | 0.5 | ○ | — | 43 | " |
| 12 | 0.5 | ○ | — | 42 | " |
| 13 | 0.5 | ○ | — | 45 | " |
| 14 | 0.5 | ○ | — | 40 | " |
| 15 | 1.1 | ○ | — | 25 | Comparative Example |
| 16 | 2.0 | ○ | — | 19 | " |
| 17 | 1.1 | ○ | — | 24 | " |
| 18 | 1.1 | ○ | — | 22 | " |

The structure of each cermet sintered body shown in Tables 1 and 2 were observed by SEM (Scanning Electron Microscope). In each of Sample Nos. 1 to 3, a hard dispersion phase mainly contains solid solutions having no core-structure, that is, the structure has a uniform distribution of composition, and further does not substantially contain any structure having cores of TiC or Ti(C, N). In each of Sample Nos. 4 to 14, a hard dispersion phase mainly contains solid-solutions having no core-structure, that is, the structure is uniform; however, it has either or both of (1) a grain composed of structures having cores of TiC or Ti(C, N) dissolved in a solid state in other solid-solution components and (2) a fine grain, having a particle size of 1 μm or less, which is composed of structures having cores of TiC or Ti(C, N). On the contrary, in each of Sample Nos. 15 to 18, a hard dispersion phase contains structure having cores of TiC or Ti(C, N) in a large amount, and the particle size is relatively large.

While the preferred embodiment of the present invention has been described using specific terms, such description is for illustrative purposes only, and it is to be understood that changes and various variations may be made without departing from the spirit or scope of the following claims.

What is claimed is:

1. A cermet sintered body comprising:

a hard dispersion phase in an amount of from 70 to 95 wt. %, comprising:

TiC and/or Ti(C, N) and at least one carbide or nitride, excluding TiC, selected from the group consisting of carbides and nitrides of elements in IVa, Va and VIa groups of the periodic system, and a binder phase in an amount of from 5 to 30 wt. %, comprising at least one element selected from the group consisting of Co, Ni and Fe, wherein said hard dispersion phase mainly comprises solid-solutions without any structure having a core, and which has a uniform distribution of composition, said cermet is formed from a raw powder comprising particles of TiC and/or Ti(C, N), wherein all of the TiC and/or Ti(C, N) in said raw powder has an average particle size of 0.8 μm or less, and said carbide or nitride is dissolved into said particles of TiC and/or Ti(C, N) during sintering, to form said hard dispersion phase.

2. The cermet sintered body of claim 1, wherein said raw powder has an average particle size of 0.5 μm or less.

3. The cermet sintered body of claim 1, wherein said raw powder has an average particle size of 0.3 μm or less.

4. The cermet sintered body of claim 1, wherein said hard dispersion phase comprises TaC, $Mo_2C$ and WC.

5. The cermet sintered body of claim 4, wherein said hard dispersion phase further comprises one carbide selected from the group consisting of ZrC, HfC, VC, NbC and $Cr_3C_2$.

6. The cermet sintered body of claim 1, wherein said binder phase comprises Co and Ni.

7. The cermet sintered body of claim 1, wherein said cermet sintered body further comprises a TiN or TiAlN coating.

8. The cermet sintered body of claim 3, wherein said hard dispersion phase does not substantially contain any structure having a core of TiC or Ti(C, N).

9. The cermet sintered body of claim 1, wherein part of said hard dispersion phase has a grain composed of structures having cores of TiC or Ti(C, N) dissolved in a solid state in other solid-solution components.

10. The cermet sintered body of claim 1, wherein part of said hard dispersion phase has a fine grain, having an average particle size of 1 μm or less, which is composed of structures having cores of TiC or Ti(C, N).

11. The cermet sintered body of claim 1, wherein part of said hard dispersion phase has both (1) a grain composed of structures having cores of TiC or Ti(C, N) dissolved in a solid state in other solid-solution components, and (2) a fine grain having an average particle size of 1 μm or less, which is composed of structures having cores of TiC or Ti(C, N).

* * * * *